US011400349B2

(12) United States Patent
Davis et al.

(10) Patent No.: US 11,400,349 B2
(45) **Date of Patent: *Aug. 2, 2022**

(54) GOLF CLUB HEAD WITH HEEL AND TOE STIFFENERS

(71) Applicant: Callaway Golf Company, Carlsbad, CA (US)

(72) Inventors: Patrick C. Davis, Carlsbad, CA (US); Michael J. Murphy, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/367,479

(22) Filed: Jul. 5, 2021

(65) Prior Publication Data

US 2022/0080269 A1 Mar. 17, 2022

Related U.S. Application Data

(63) Continuation of application No. 16/951,105, filed on Nov. 18, 2020, now Pat. No. 11,052,293.

(60) Provisional application No. 63/077,601, filed on Sep. 12, 2020.

(51) Int. Cl.
*A63B 53/04* (2015.01)
*A63B 53/08* (2015.01)

(52) U.S. Cl.
CPC ..... *A63B 53/045* (2020.08); *A63B 53/0412* (2020.08); *A63B 53/0416* (2020.08); *A63B 53/0433* (2020.08); *A63B 53/0437* (2020.08); *A63B 53/0466* (2013.01); *A63B 53/08* (2013.01); *A63B 2053/0491* (2013.01)

(58) Field of Classification Search
CPC ..... A63B 53/045; A63B 53/0416; A63B 53/0412; A63B 53/0433; A63B 53/08; A63B 53/0466; A63B 53/0437
USPC ..... 473/324–350, 287–292
See application file for complete search history.

(56) References Cited

U.S. PATENT DOCUMENTS 5,026,056 A * 6/1991 McNally ..... A63B 53/04 473/291
5,467,983 A * 11/1995 Chen ..... A63B 53/0466 473/346
5,482,279 A * 1/1996 Antonious ..... A63B 60/00 473/328
RE35,955 E * 11/1998 Lu ..... A63B 60/00 473/345

(Continued)

*Primary Examiner* — Sebastiano Passaniti
(74) *Attorney, Agent, or Firm* — Rebecca Hanovice; Michael Catania; Sonia Lari

(57) ABSTRACT

A golf club head with plate-like, heel and toe side internal stiffeners is disclosed herein. Each stiffener has a planar portion extending approximately parallel with a portion of the striking face, and is entirely disposed within an interior cavity of the golf club head. The heel side stiffener is connected to top, sole, and heel walls of the club head, with a toe-side edge unconnected to any other portion of the head, and the toe side stiffener is connected to the top, sole, and toe walls of the club head, with a heel-side edge unconnected to any other portion of the head. The toe and heel side edges may have large concavities that distribute mass away from the geometric face center and toward the heel and toe sides of the golf club head.

15 Claims, 8 Drawing Sheets

(56) References Cited

U.S. PATENT DOCUMENTS 5,941,782 A * 8/1999 Cook ..... A63B 53/04 473/346
6,165,081 A * 12/2000 Chou ..... A63B 60/46 473/345
6,299,547 B1 * 10/2001 Kosmatka ..... A63B 53/0466 473/345
6,383,090 B1 * 5/2002 O'Doherty ..... A63B 53/0466 473/345
6,695,715 B1 * 2/2004 Chikaraishi ..... A63B 53/0466 473/345
6,852,038 B2 * 2/2005 Yabu ..... A63B 53/0466 473/332
7,056,228 B2 * 6/2006 Beach ..... A63B 53/0466 473/345
7,118,493 B2 * 10/2006 Galloway ..... A63B 53/04 473/224
7,192,364 B2 * 3/2007 Long ..... A63B 53/04 473/345
7,798,913 B2 * 9/2010 Noble ..... A63B 53/0466 473/335
7,854,364 B2 * 12/2010 DeShiell ..... A63B 60/00 473/345
8,187,116 B2 * 5/2012 Boyd ..... A63B 60/42 473/333
8,540,587 B2 * 9/2013 Hirsch ..... A63B 53/0466 473/332
8,834,294 B1 * 9/2014 Seluga ..... A63B 53/04 473/345
8,900,070 B1 * 12/2014 Dawson ..... A63B 60/02 473/335
9,457,241 B2 * 10/2016 Hebreo ..... A63B 53/0487
9,486,677 B1 * 11/2016 Seluga ..... A63B 53/0466
9,889,349 B1 * 2/2018 Seluga ..... A63B 60/00
9,981,167 B2 * 5/2018 Seluga ..... A63B 53/0475
9,993,699 B2 * 6/2018 Larson ..... A63B 60/54
10,258,846 B1 * 4/2019 Nunez ..... A63B 53/06
10,343,037 B2 * 7/2019 Hebreo ..... A63B 53/0466
10,406,414 B2 * 9/2019 Galvan ..... A63B 60/00
11,052,293 B1 * 7/2021 Davis ..... A63B 53/0437
2004/0033844 A1 * 2/2004 Chen ..... A63B 53/0466 473/345
2010/0227703 A1 * 9/2010 Beach ..... A63B 60/00 473/335
2015/0258394 A1 * 9/2015 Franklin ..... A63B 60/00 473/332

* cited by examiner

GOLF CLUB HEAD WITH HEEL AND TOE STIFFENERS

CROSS REFERENCES TO RELATED APPLICATIONS

The present application is a continuation of U.S. patent application Ser. No. 16/951,105, filed on Nov. 18, 2020, and issued on Jul. 6, 2021, as U.S. Pat. No. 11,052,293, which claims priority to U.S. Provisional Application No. 63/077,601, filed on Sep. 12, 2020, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head, and particularly a hybrid-type golf club head, with plate-like heel and toe stiffeners extending between, and connecting, crown and sole portions of the golf club head.

Description of the Related Art

The prior art discloses various golf club heads having interior structures. For example, Kosmatka, U.S. Pat. No. 6,299,547 for a Golf Club Head with an Internal Striking Plate Brace, discloses a golf club head with a brace to limit the deflection of the striking plate. Yabu, U.S. Pat. No. 6,852,038 for a Golf Club Head and Method of Making the Same, discloses a golf club head with a sound bar. Galloway, U.S. Pat. No. 7,118,493 for a Multiple Material Golf Club Head discloses a golf club head with a composite aft body having an interior sound component extending upward from a sole section of a metal face component. Seluga et al., U.S. Pat. No. 8,834,294 for a Golf Club Head with Center of Gravity Adjustability discloses a golf club head with a tube having a mass for adjusting the CG of a golf club head. Dawson et al., U.S. Pat. No. 8,900,070 for a Weighted Golf Club Head discloses a golf club head with an interior weight lip extending from the sole towards the face. However, the prior art fails to disclose an interior structure that increases ball speed and reduces stress in the face at impact, without over-stiffening the head in regions where it needs to flex.

BRIEF SUMMARY OF THE INVENTION

One aspect of the present invention is a golf club head comprising a metal body comprising a sole portion, a front wall, a return portion, a hosel, a heel side with a heel side wall, a toe side with a toe side wall, a flange portion encircling an upper opening, an interior cavity, a volume of 75 cc to 460 cc, and a face opening in the front wall, a composite crown insert affixed to the body to cover the upper opening, a metal face insert comprising a striking face surface, a rear surface, and a geometric face center, the face insert affixed to the body to cover the face opening, a heel side stiffener comprising a first planar front surface, a first planar rear surface, a first upper edge connected to the return section, a first lower edge connected to the sole portion, a first heel edge connected to the heel side wall, and a first toe edge, a toe side stiffener comprising a second planar front surface, a second planar rear surface, a second upper edge connected to the return section, a second lower edge connected to the sole portion, a second toe edge connected to the toe side wall, and a second heel edge, wherein each of the heel side stiffener and toe side stiffener is disposed entirely within the interior cavity, wherein each of the first and second planar front surfaces extends approximately parallel with a rear surface of the face insert, wherein the first toe edge is spaced a distance of at least 1 inch measured along a horizontal y-axis from the second heel edge, and wherein each of the heel side stiffener and the toe side stiffener is spaced a distance from the rear surface of the face insert of no more than 0.85 inch measured along a horizontal x-axis.

In some embodiments, the first toe edge may be spaced a distance of at least 0.25 inch from the geometric face center measured along a horizontal y-axis. In other embodiments, the second heel edge may be spaced a distance of at least 0.65 inch from the geometric face center measured along a horizontal y-axis. In a further embodiment, the first toe edge may be spaced a distance of at least 0.25 inch from the geometric face center measured along a horizontal y-axis. In another, embodiment, the first toe edge may be spaced a distance of approximately 1.2 inch from the geometric face center, and the second heel edge may be spaced a distance of approximately 1.4 inch from the geometric center. In any embodiment, each of the heel side stiffener and the toe side stiffener may have a maximum thickness of 0.2 inch. In a further embodiment, each of the heel side stiffener and the toe side stiffener may have a variable thickness. In some embodiments, at least one of the first toe edge and the second heel edge may have a concavity. In a further embodiment, each of the first toe edge and the second heel edge may have a concavity.

Another aspect of the present invention is a hybrid golf club head comprising a metal body comprising a sole portion, a front wall, a return portion, a hosel, a heel side with a heel side wall, a toe side with a toe side wall, a flange portion encircling an upper opening, an interior cavity, a volume of 75 cc to 250 cc, and a face opening in the front wall, a composite crown insert affixed to the body to cover the upper opening, a metal face insert comprising a striking face surface, a rear surface, and a geometric face center, the face insert affixed to the body to cover the face opening, a planar heel side stiffener comprising a first front surface, a first rear surface, a first upper edge connected to the return section, a first lower edge connected to the sole portion, a first heel edge connected to the heel side wall, and a first toe edge, a planar toe side stiffener comprising a second front surface, a second rear surface, a second upper edge connected to the return section, a second lower edge connected to the sole portion, a second toe edge connected to the toe side wall, and a second heel edge, wherein each of the planar heel side stiffener and the planar toe side stiffener is disposed entirely within the interior cavity, wherein each of the first and second front surfaces extends approximately parallel with a rear surface of the face insert, wherein the first toe edge is spaced a distance of at least 0.90 inch measured along a horizontal y-axis from the second heel edge, wherein each of the planar heel side stiffener and the planar toe side stiffener is spaced a distance from the rear surface of the face insert of no more than 0.85 inch measured along a front-to-back x-axis, and wherein each of the planar heel side stiffener and the planar toe side stiffener has a variable thickness that is no greater than 0.20 inch.

In some embodiments, the first toe edge may be spaced a distance of approximately 1.2 inch from the geometric face center, and wherein the second heel edge may be spaced a distance of approximately 1.4 inch from the geometric center. In another embodiment, the first toe edge may be spaced a first distance from the geometric face center measured along a horizontal y-axis, the second heel edge may be spaced a second distance from the geometric center measured along the horizontal y-axis, and the second distance may be greater than or equal to the first distance. In a further embodiment, the second distance may be at least 0.40 inch greater than the first distance. In another embodiment, the second distance may be at least 0.65 inch, and the first distance may be at least 0.25 inch.

In any of the embodiments, the sole portion may comprise a weight port. In another embodiment, at least one of the first toe edge and the second heel edge may have a concavity. In a further embodiment, each of the first toe edge and the second heel edge may have a concavity. In any of the embodiments, the return section may comprise at least one upper rib, and at least one of the first upper edge and the second upper edge may be connected to the at least one upper rib. In any of the embodiments, the sole portion may comprise at least one lower rib, and at least one of the first lower edge and the second lower edge may be connected to the at least one lower rib. In a further embodiment, the return section may comprise at least one upper rib, and at least one of the first upper edge and the second upper edge may be connected to the at least one upper rib Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
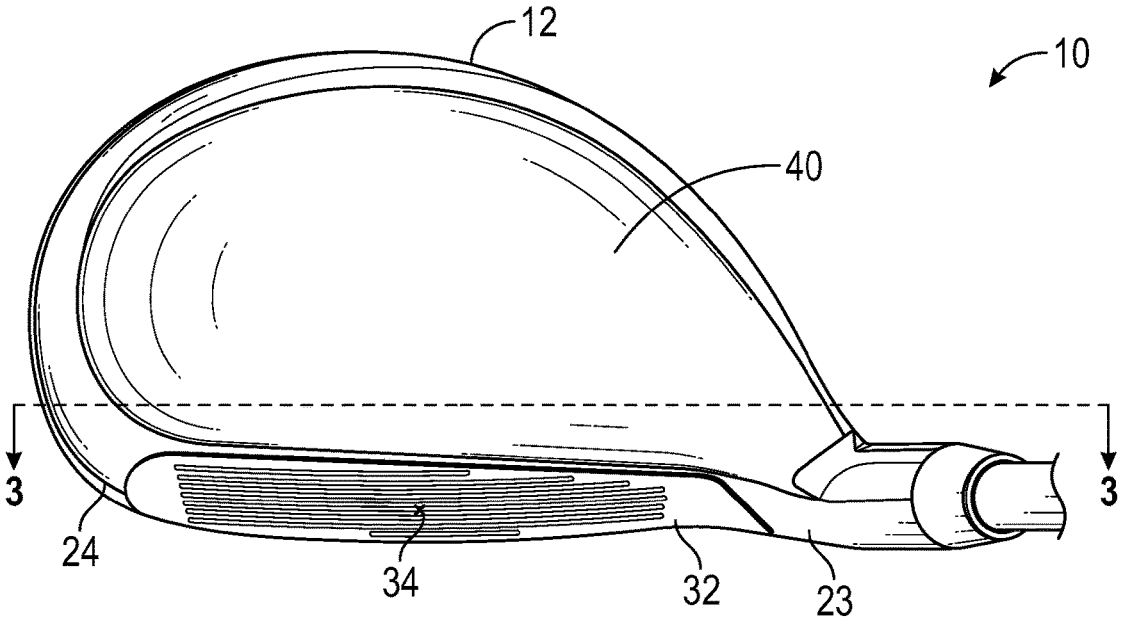
FIG. 1 is a top elevational view of a first embodiment of the present invention.
Figure 2:
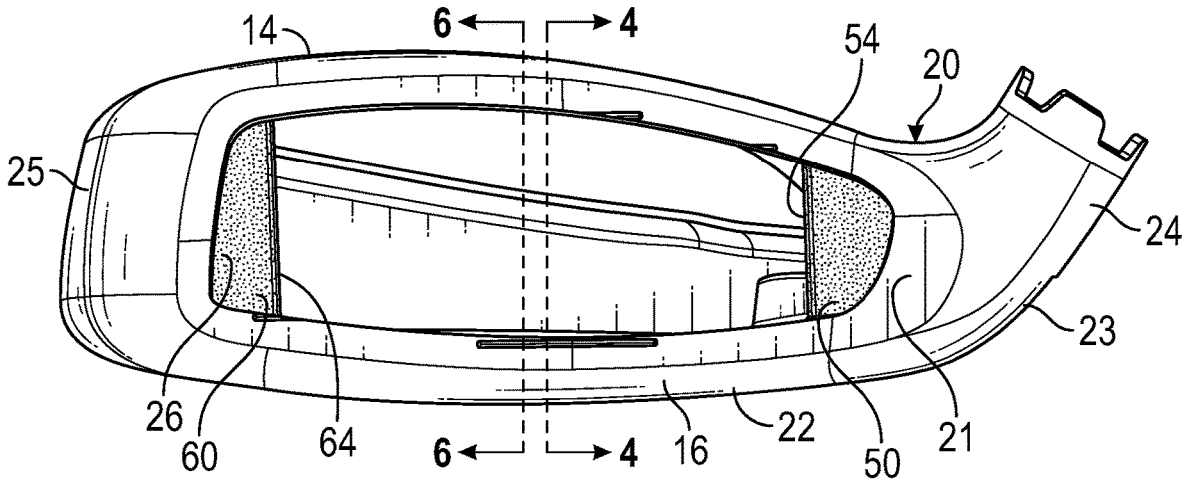
FIG. 2 is a front elevational of the embodiment shown in FIG. 1 with its crown and face inserts removed.
Figure 3:
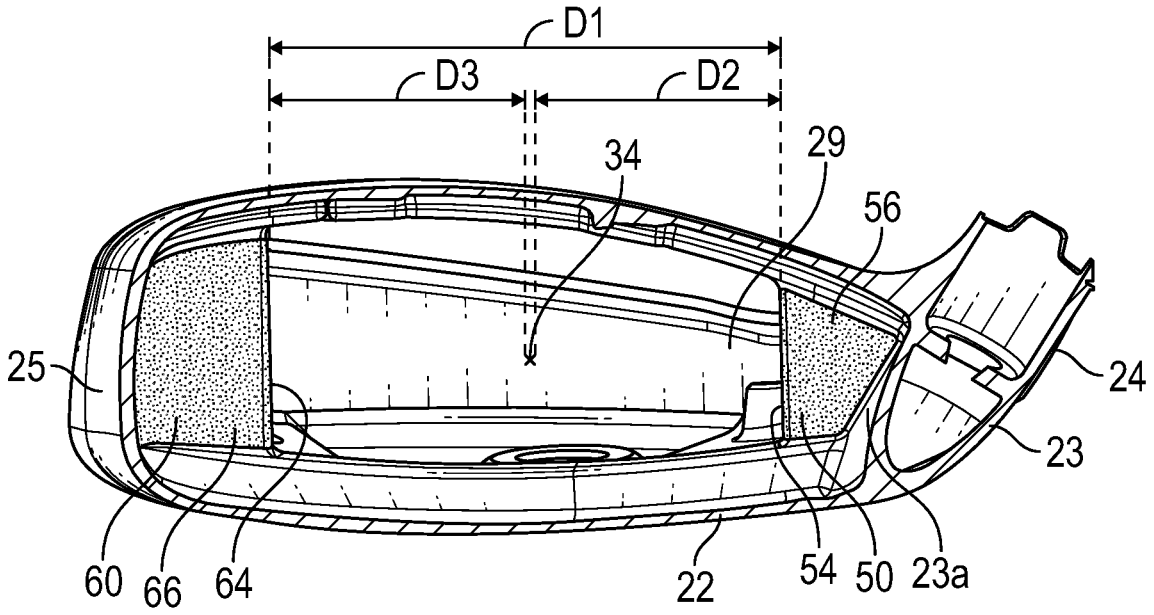
FIG. 3 is a cross-sectional view of the embodiment shown in FIG. 1 taken along lines 3-3.
Figure 4:
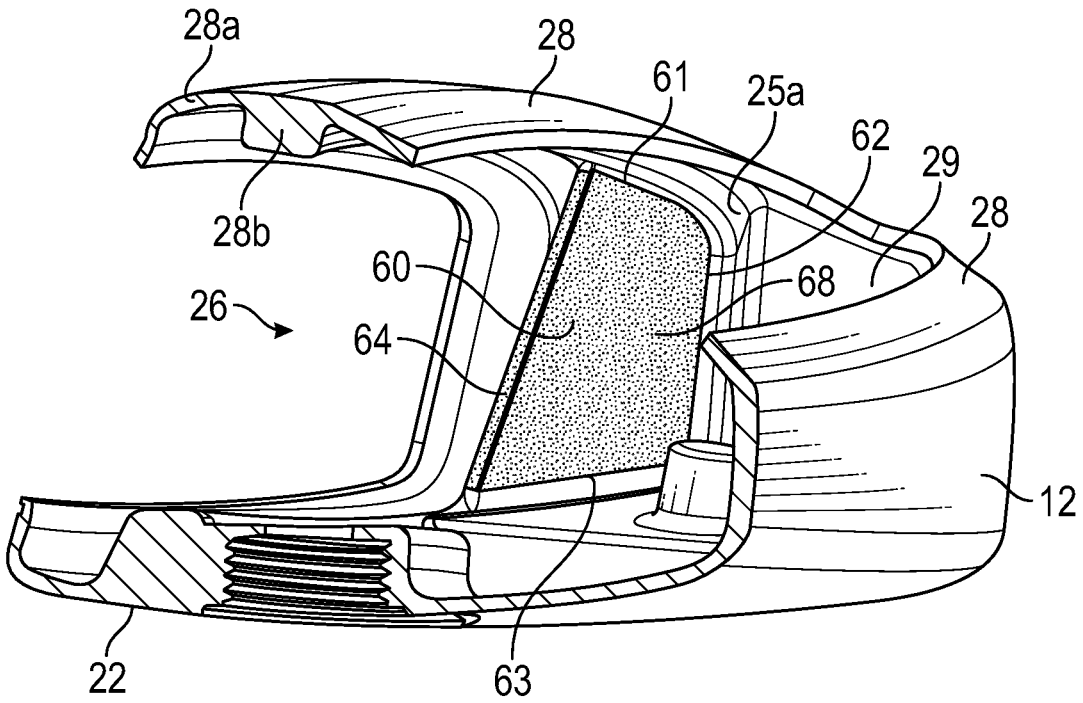
FIG. 4 is a cross-sectional view of the embodiment shown in FIG. 2 taken along lines 4-4.
Figure 5:
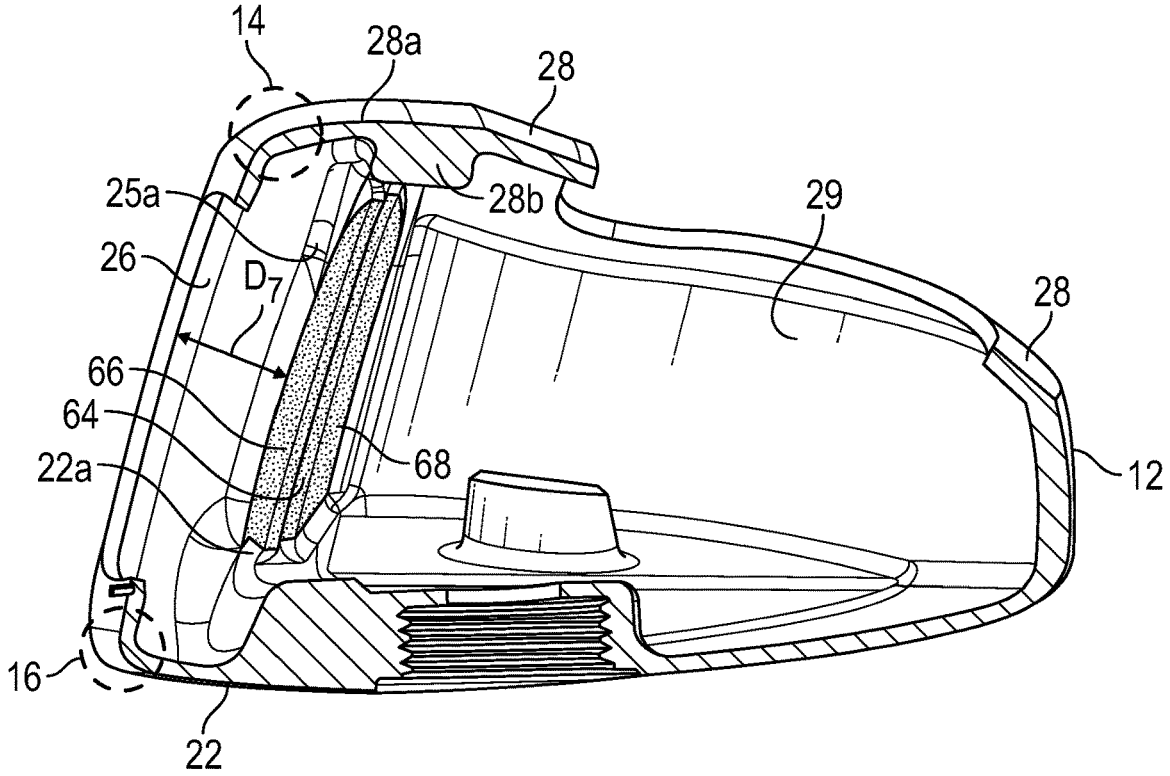
FIG. 5 is side plan view of the embodiment shown in FIG. 5.
Figure 6:
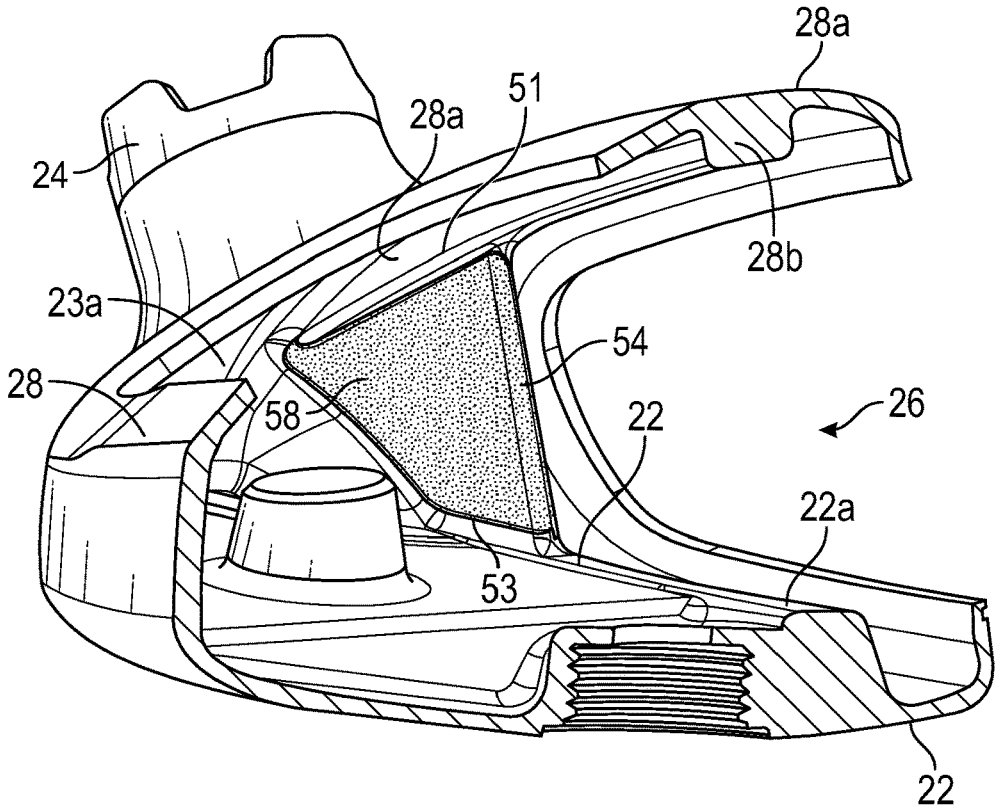
FIG. 6 is a cross-sectional view of the embodiment shown in FIG. 2 taken along lines 6-6.
Figure 7:
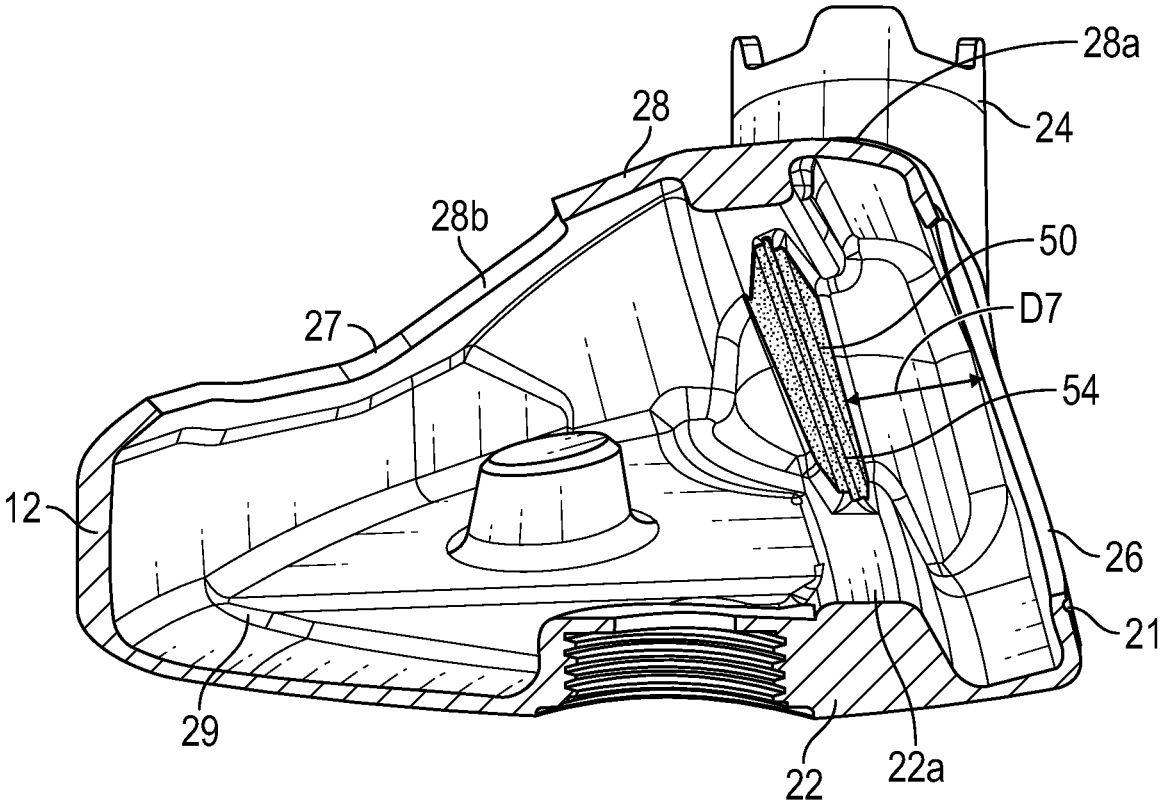
FIG. 7 is side plan view of the embodiment shown in FIG. 6.
Figure 8:
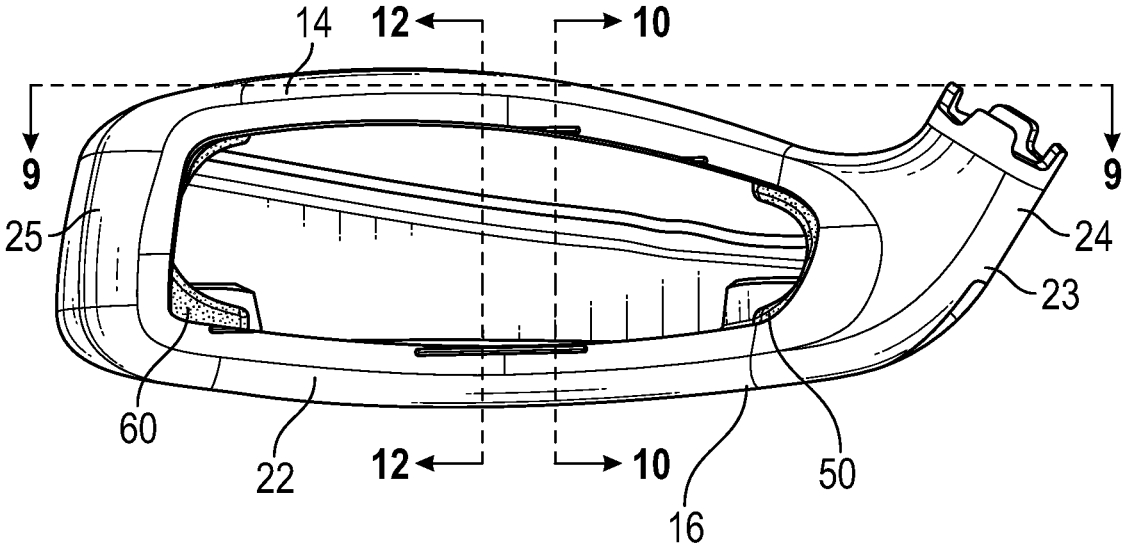
FIG. 8 is a front elevational of a second embodiment of the present invention with its crown and face inserts removed.
Figure 9:
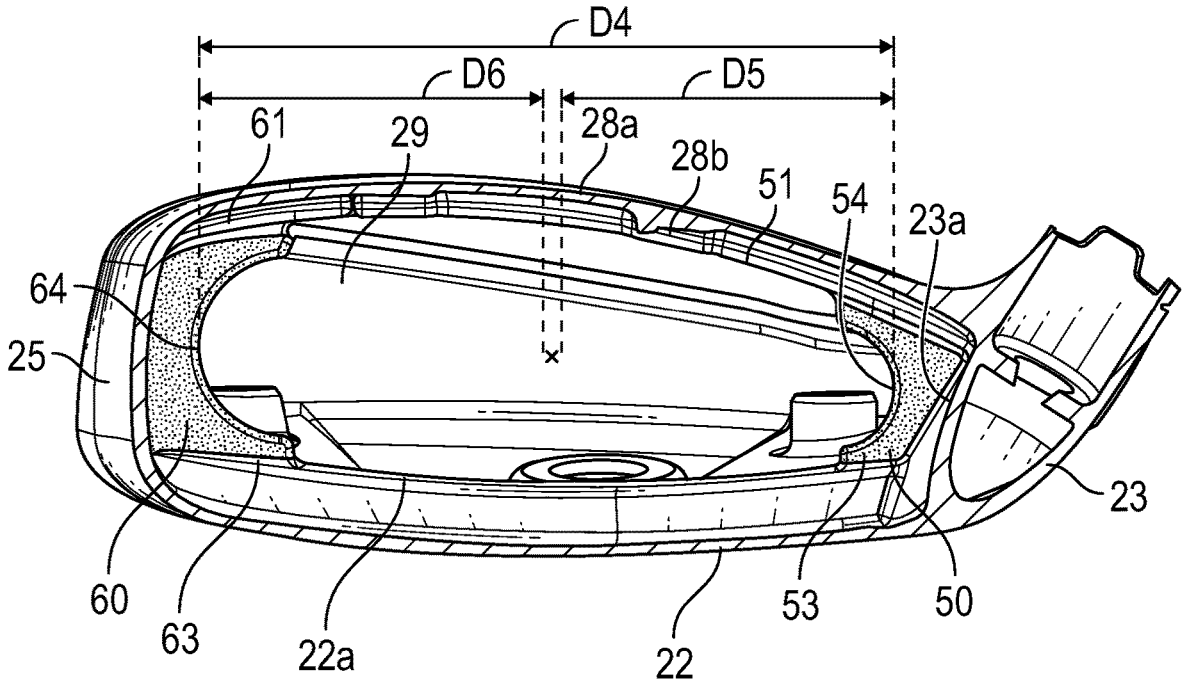
FIG. 9 is a cross-sectional view of the embodiment shown in FIG. 8 taken along lines 9-9.
Figure 10:
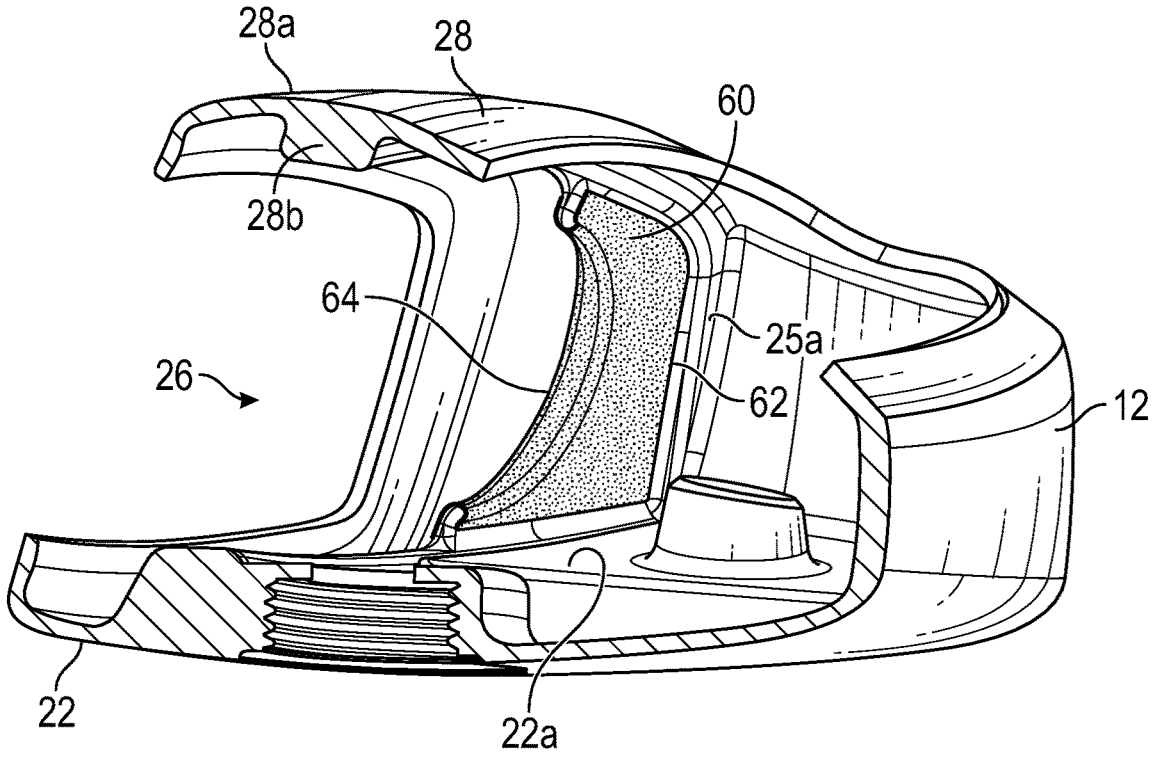
FIG. 10 is a cross-sectional view of the embodiment shown in FIG. 8 taken along lines 10-10.
Figure 11:
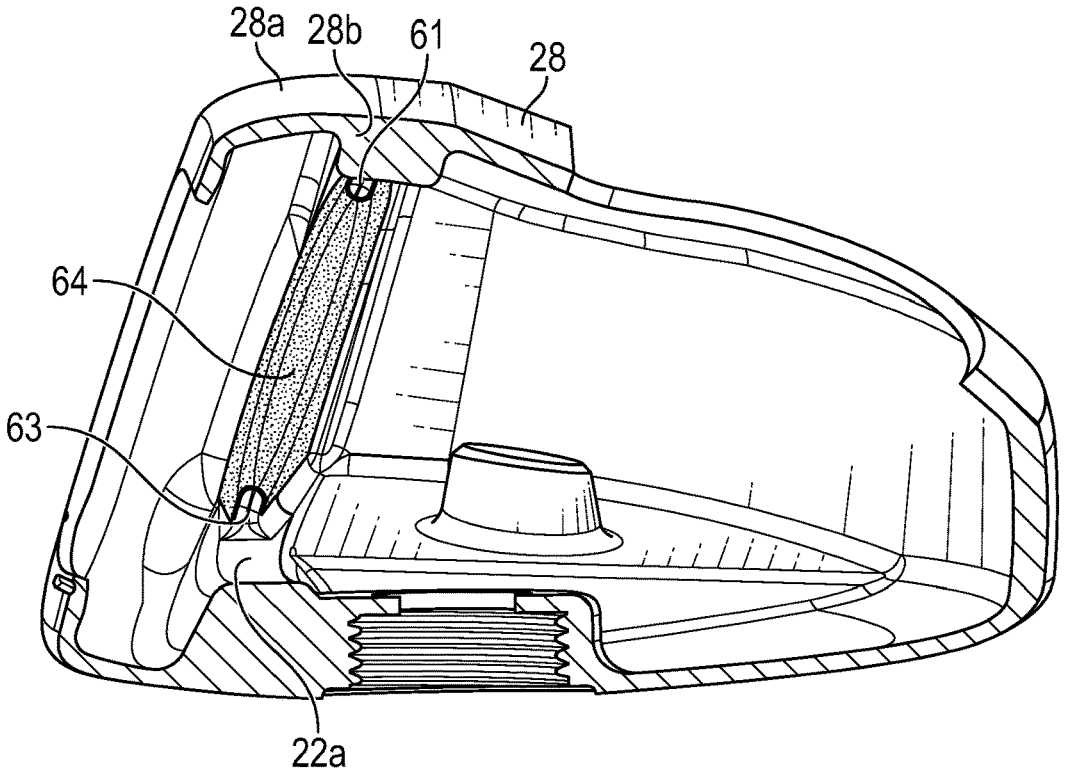
FIG. 11 is a side plan view of the embodiment shown in FIG. 11.
Figure 12:
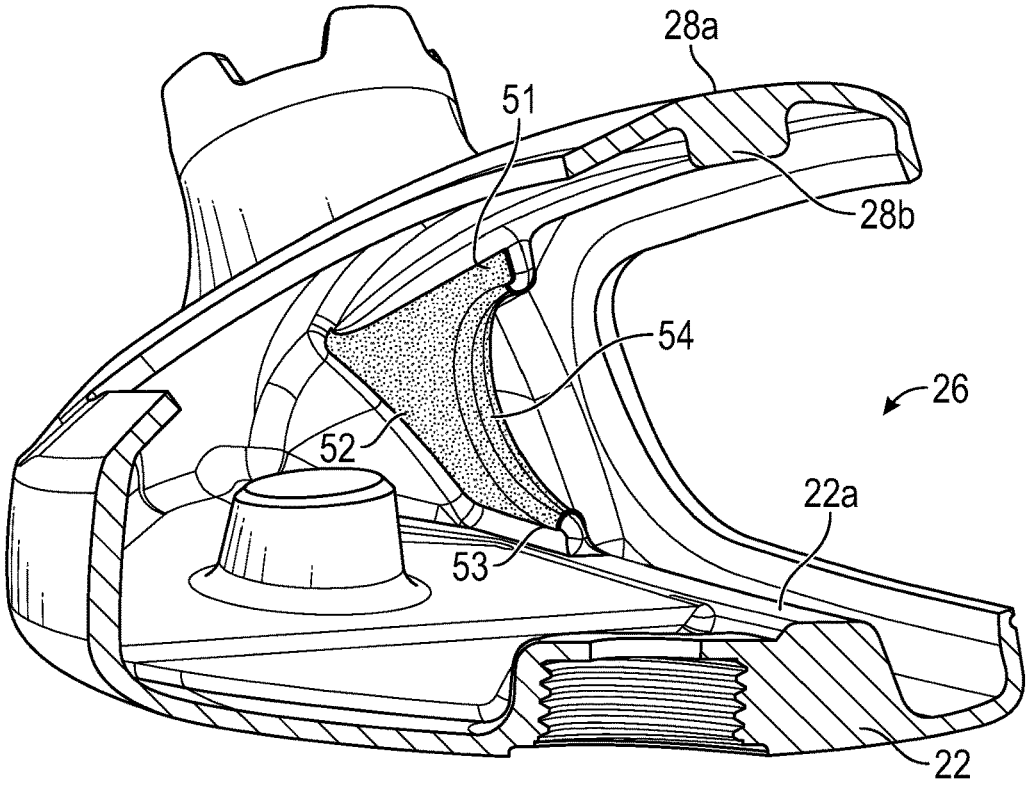
FIG. 12 is a cross-sectional view of the embodiment shown in FIG. 8 taken along lines 12-12.
Figure 13:
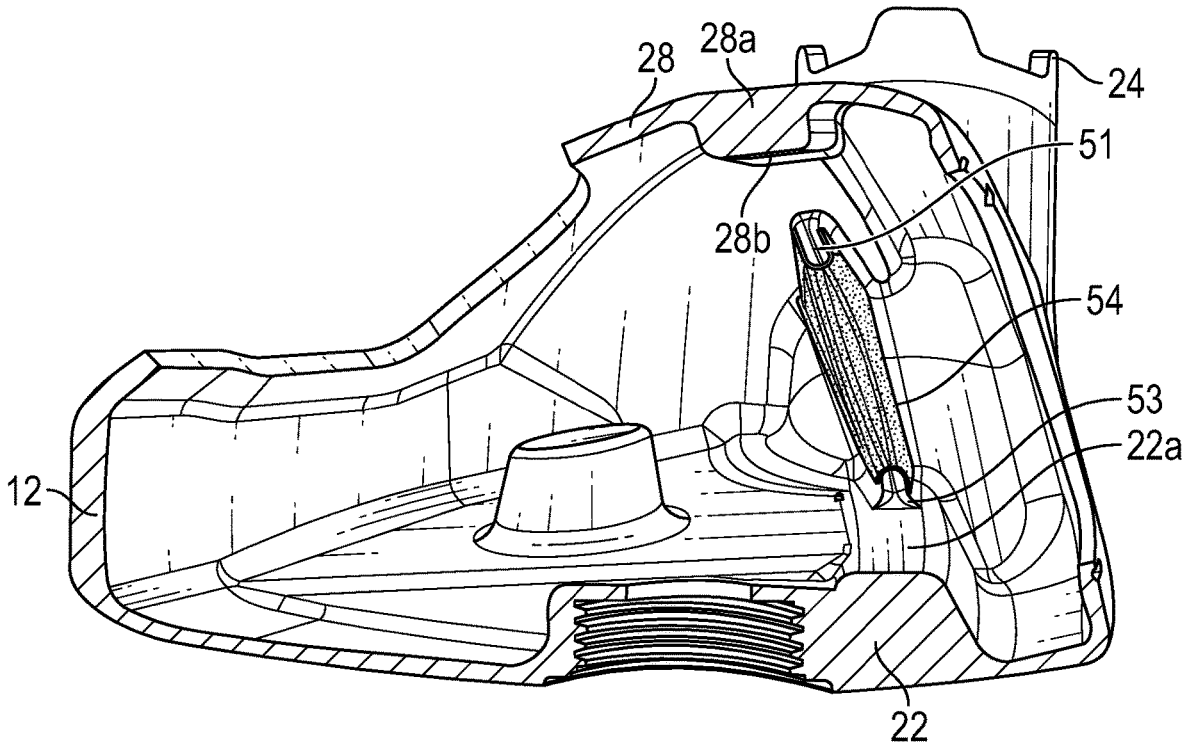
FIG. 13 is a side plan view of the embodiment shown in FIG. 12.

The present invention is directed to a golf club head, and particular a hybrid golf club head, with stiffeners that extend between crown and sole portions and that are entirely contained within heel and toe regions of the body. The dimensions of the stiffeners, and particularly their heel-to-toe widths, are related to the dimensions of the body of the golf club head, particularly its shaping, volume, heel to toe width, and front to back length. The plate-like stiffeners engage the heel and toe walls, but allow for necessary flex and deflection of the sole and crown hinge region near the center of the face during impact with a golf all, thereby reducing characteristic time while maintaining coefficient of restitution and ball speed. The location of the stiffeners' masses at the heel and toe portions of the club head also benefits the club's moments of inertia, and are mass efficient because they do not need to span the tallest section of the golf club head near the center of the face.

A first, preferred embodiment is shown in FIGS. 1-7. In this embodiment, the golf club 10 comprises a metal body 20 with a front wall 21, a sole portion 22, a heel side 23 with a heel side wall 23*a* proximate a hosel 24, a toe side 25 with a toe side wall 25*a* opposite the heel side 23, a face opening 26, an upper opening 27 encircled by a flange 28 and bounded at the front by a return portion 28*a*, and a hollow interior 29. A metal face insert 30 is welded to the front wall 21 to close the face opening 26, and a composite crown insert 40 is glued to the flange 28 to close the upper opening 27. When the face insert 30 is affixed to the body 20, it comprises a striking surface 32 that includes a geometric face center 34 and a rear surface 36. The golf club head 10 includes a rear side 12, a crown hinge region 14 and a sole hinge region 16.

The body 20 also includes a heel-side stiffener 50 and a toe-side stiffener 60. The heel side stiffener 50 has a heel edge 52 that is affixed to the heel side wall 23*a*, a toe edge 54 that faces the hollow interior 29, a front surface 56 facing the front wall 21 and the face insert 30, and a rear surface 58 facing the rear side 12 of the golf club head 10. The heel-side stiffener 50 also includes an upper edge 51 that is affixed to the return portion 28*a* and a lower edge 53 that is affixed to the sole portion 22. The toe-side stiffener 60 has a toe edge 62 that is affixed to the toe side wall 25*a*, a heel edge 64 that faces the hollow interior 29, a front surface 66 facing the front wall 21 and the face insert 30, and a rear surface 68 facing the rear side 12 of the golf club head 10. The toe-side stiffener 60 also includes an upper edge 61 that is affixed to the return portion 28*a* and a lower edge 63 that is affixed to the sole portion 22.

Figure 14:
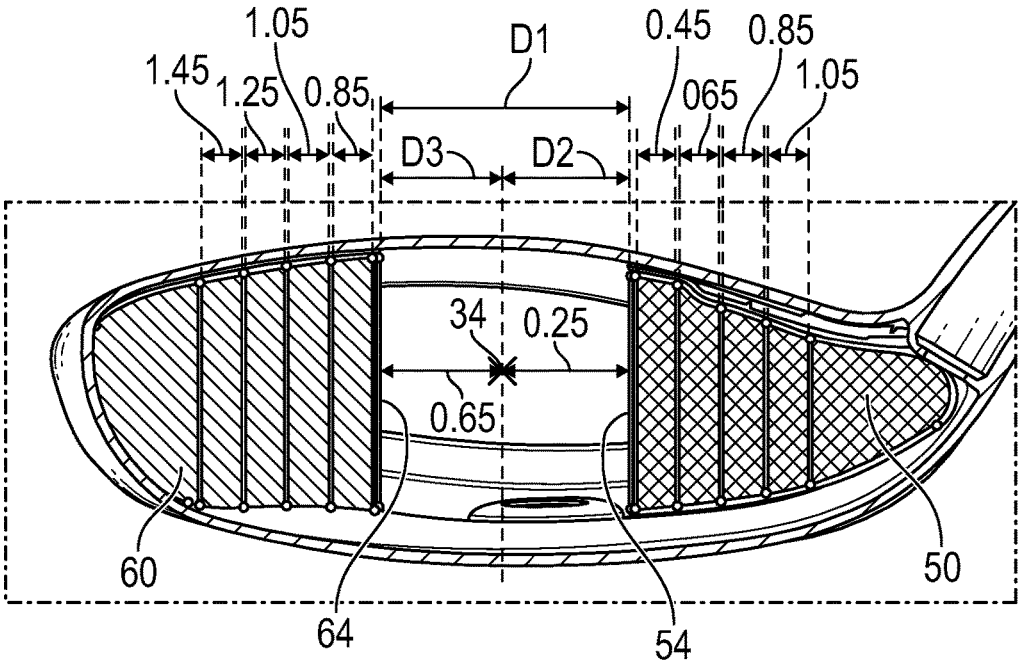
FIG. 14 is a cross-sectional view of another embodiment with alternative stiffener dimensions.

When the golf club head 10 is fully assembled, the entire heel edge 64 of the toe-side stiffener 60 is spaced a distance $D_1$ of at least 0.9 inch from the entire toe edge 54 of the heel-side stiffener 50 as shown in FIG. 14, which illustrates different possible spacing and widths of the stiffeners 50, 60, all measured along the horizontal y-axis. Preferably, the toe edge 54 of the heel-side stiffener 50 is spaced a distance $D_2$ of at least 0.25 inch from the geometric center 34, and more preferably, the toe edge 54 of the heel side stiffener is spaced approximately 1.2 inch from the geometric face center. The heel edge 64 of the toe-side stiffener 60 preferably is spaced a distance $D_3$ of at least 0.65 inch from the geometric face center 34, and more preferably approximately 1.44 inches.

In some embodiments, distances $D_2$ and $D_3$ may be equivalent to one another, but preferably $D_2$ is greater than $D_3$.

Each of the stiffeners 50, 60 has a maximum thickness of no more than 0.20 inch, and have variable thicknesses that taper from their midsections towards the edges of the stiffeners 50, 60. In the preferred embodiment, the heel-side stiffener 50 has an average thickness of 0.045 inch, while the toe-side stiffener 60 has an average thickness of 0.067 inch.

The preferred embodiment confers performance improvements on the golf club head when compared with an identical golf club head that lacks the novel stiffeners 50, 60. As shown in Table I, the stiffeners 50, 60 increases the MOI along the x and z axes, which are particularly important for spin robustness in hybrid-type golf club heads. The stiffeners also move the center of gravity (cg) closer to the face along the horizontal, face to rear x-axis. As shown in Table II, while the characteristic time drops slightly, the stiffeners 50, 60 maintain the coefficient of restitution (COR) and ball speed compared with a golf club head having no stiffeners 50, 60, and also reduce stress on the golf club head 10.

TABLE I

| | Impact Frame Mass Properties (No Stiffener) | | | Impact Frame Mass Properties (Vertical Wall Stiffener) | | | Units |
|---|---|---|---|---|---|---|---|
| Cg(x), Cg(y), Cg(z) | 0.807 | 0.01 | 0.05 | 0.796 | 0.005 | 0.057 | in |
| I(xx), I(yy) I(zz) | 2291 | 761 | 2564 | 2444 | 770 | 2716 | g*cm$^2$ |
| I(xy), I(xz), I(yz) | 314 | −25 | −53 | 313 | −28 | −46 | g*cm$^2$ |

| Metric | No stiffener | Vertical Wall Stiffener |
|---|---|---|
| Characteristic Time (μs) | 242.7 | 240.9 |
| Coefficient of Restitution | 0.878 | 0.878 |
| Ball Speed (mph) | 135.96 | 135.96 |
| Backspin (rpm) | 3724.5 | 3739.6 |
| Launch Angle (°) | 15.56 | 15.54 |
| Maximum Face IML Stress (ksi) | 581.80 | 571.30 |
| Average Face IML Stress (ksi) | 426.37 | 417.44 |

A second embodiment is shown in FIGS. 8-13. The golf club head 10 of this second embodiment includes many of the same features as the first embodiment, except that the toe edge 54 of the heel side stiffener 50 and the heel edge 64 of the toe-side stiffener 60 each include large concavities, so that the spacing between the toe edge 54 of the heel side stiffener 50 and the heel edge 64 of the toe-side stiffener has a variable distance $D_4$. Similarly, the distances $D_5$ and $D_6$ between the geometric face center 34 and these edges 54, 64 are also variable. The concavities allow discretionary mass to be moved to other portions of the golf club head 10 without reducing the beneficial, stiffening effects provided by the stiffeners 50, 60.

Figure 15:
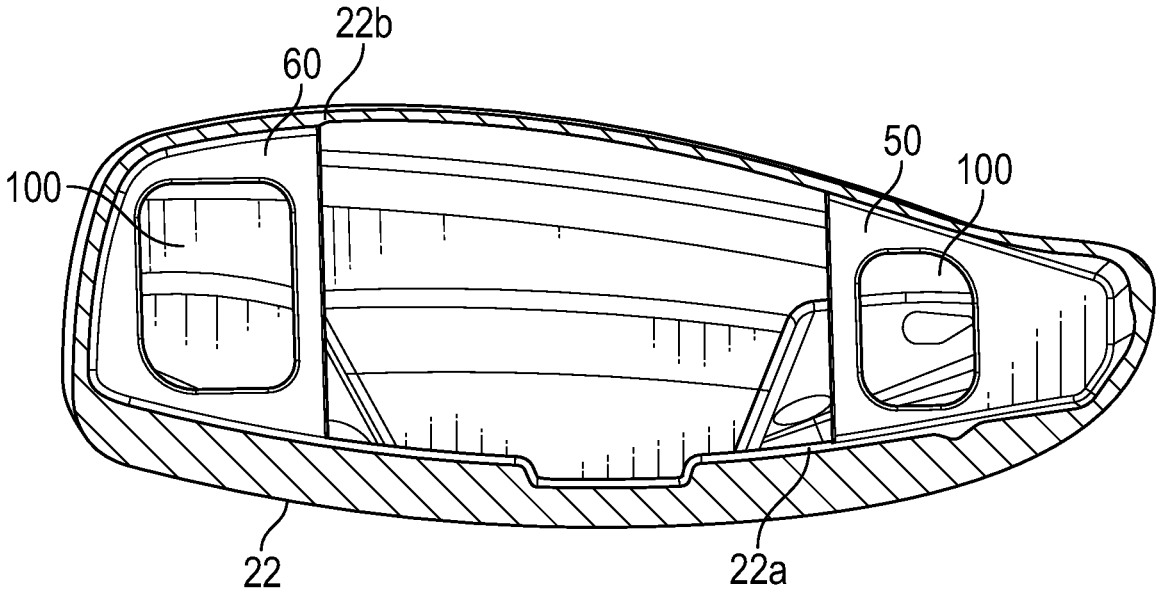
FIG. 15 is a cross-sectional view of another embodiment with through-holes in the stiffeners.

In each of the embodiments, the front and rear surfaces 56, 58, 66, 68 of the stiffeners 50, 60 are planar and preferably extend approximately parallel with the rear surface 36 of the face insert 30. The return section 28*a* and the sole portion 22 also each have reinforced portions, taking the form of upper and lower ribs 28*b*, 22*a*, to which the stiffeners 50, 60 are affixed. Each stiffener 50, 60 is preferably integrally formed with the body 20, but in alternative embodiments one or both of them can be manufactured separately from the body 20 and then affixed within the hollow interior 29 using welding, brazing, or adhesives. Also, in each embodiment, both stiffeners 50, 60 are entirely located within 1 inch of the rear surface 36 of the face insert 30 measured along a front-to-back x-axis, and more preferably are spaced a distance $D_7$ of no more than 0.85 inch. In any of the embodiments, either or both of the stiffeners 50, 60 may have a through-hole or cutout 100, as shown in FIG. 15.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. The section titles included herein also are not intended to be limiting. Therefore, the embodiments of the invention in which an exclusive property or privilege is claimed are defined in the following appended claims.

We claim:

1. A golf club head comprising:

a body comprising a sole portion, a front wall, a return portion, a hosel, a heel side with a heel side wall, a toe side with a toe side wall, a flange portion encircling an upper opening, an interior cavity, and a face opening in the front wall;

a crown insert affixed to the body to cover the upper opening;

a face insert comprising a striking face surface, a rear surface, and a geometric face center, the face insert affixed to the body to cover the face opening;

a heel side stiffener comprising a first planar front surface, a first planar rear surface, a first upper edge connected to the return section, a first lower edge connected to the sole portion, a first heel edge connected to the heel side wall, and a first toe edge;

a toe side stiffener comprising a second planar front surface, a second planar rear surface, a second upper edge connected to the return section, a second lower edge connected to the sole portion, a second toe edge connected to the toe side wall, and a second heel edge, wherein each of the heel side stiffener and the toe side stiffener is disposed entirely within the interior cavity, wherein each of the first and second planar front surfaces extends approximately parallel with a rear surface of the face insert, wherein the first toe edge is spaced a distance of at least 1 inch measured along a horizontal y-axis from the second heel edge, wherein each of the heel side stiffener and the toe side stiffener has a midsection and has a variable thickness that tapers from the midsection towards at least one of the respective edges of each of the heel side and toe side stiffeners, wherein the heel side stiffener has an average thickness that is greater than an average thickness of the toe side stiffener, wherein the first toe edge is spaced a first distance of at least 0.25 inch measured along a horizontal y-axis from the geometric face center, wherein the second heel edge is spaced a second distance of at least 0.65 inch measured along the horizontal y-axis from the geometric face center, and wherein the second distance is greater than the first distance.

2. The golf club head of claim 1, wherein the first toe edge is spaced a distance of approximately 1.2 inch from the geometric face center, and wherein the second heel edge is spaced a distance of approximately 1.4 inch from the geometric center.

3. The golf club head of claim 1, wherein each of the heel side stiffener and the toe side stiffener has a maximum thickness of 0.2 inch.

4. The golf club head of claim 1, wherein at least one of the first toe edge and the second heel edge has a concavity.

5. The golf club head of claim 4, wherein each of the first toe edge and the second heel edge has a concavity, such that spacing between the first toe edge and the second heel edge varies.

6. A golf club head comprising:

a metal body comprising a sole portion, a front wall, a return portion, a hosel, a heel side with a heel side wall, a toe side with a toe side wall, a flange portion encircling an upper opening, an interior cavity, and a face opening in the front wall;

a composite crown insert affixed to the body to cover the upper opening;

a metal face insert comprising a striking face surface, a rear surface, and a geometric face center, the face insert affixed to the body to cover the face opening;

a planar heel side stiffener comprising a first front surface, a first rear surface, a first upper edge connected to the return section, a first lower edge connected to the sole portion, a first heel edge connected to the heel side wall, and a first toe edge;

a planar toe side stiffener comprising a second front surface, a second rear surface, a second upper edge connected to the return section, a second lower edge connected to the sole portion, a second toe edge connected to the toe side wall, and a second heel edge, wherein each of the planar heel side stiffener and the planar toe side stiffener is disposed entirely within the interior cavity, wherein each of the first and second front surfaces extends approximately parallel with a rear surface of the face insert, wherein the first toe edge is spaced a distance of at least 0.90 inch measured along a horizontal y-axis from the second heel edge, wherein each of the planar heel side stiffener and the planar toe side stiffener has a variable thickness that is no greater than 0.20 inch and that tapers from the midsection towards at least one of the respective edges of each of the planar heel side and planar toe side stiffeners, wherein the heel side stiffener has an average thickness that is greater than an average thickness of the toe side stiffener, wherein the first toe edge is spaced a first distance measured along a horizontal y-axis from the geometric face center, wherein the second heel edge is spaced a second distance measured along the horizontal y-axis from the geometric face center, wherein the second distance is greater than the first distance, and wherein spacing between the first toe edge and the second heel edge is variable.

7. The golf club head of claim 6, wherein the first toe edge is spaced a minimum distance of approximately 1.2 inch from the geometric face center, and wherein the second heel edge is spaced a minimum distance of approximately 1.4 inch from the geometric center.

8. The golf club head of claim 6, wherein the second distance is at least 0.40 inch greater than the first distance.

9. The golf club head of claim 8, wherein the second distance is at least 0.65 inch, and wherein the first distance is at least 0.25 inch.

10. The golf club head of claim 6, wherein the sole portion comprises a weight port.

11. The golf club head of claim 6, wherein at least one of the first toe edge and the second heel edge has a concavity.

12. The golf club head of claim 11, wherein each of the first toe edge and the second heel edge has a concavity.

13. The golf club head of claim 6, wherein the return section comprises at least one upper rib, and wherein at least one of the first upper edge and the second upper edge is connected to the at least one upper rib.

14. The golf club head of claim 6, wherein the sole portion comprises at least one lower rib, and wherein at least one of the first lower edge and the second lower edge is connected to the at least one lower rib.

15. The golf club head of claim 14, wherein the return section comprises at least one upper rib, and wherein at least one of the first upper edge and the second upper edge is connected to the at least one upper rib.

* * * * *